US009778623B2

(12) United States Patent
Nishihara

(10) Patent No.: US 9,778,623 B2
(45) Date of Patent: Oct. 3, 2017

(54) ELECTRONIC TIMEPIECE AND OPERATION SETTING SWITCHING SYSTEM

(71) Applicant: CASIO COMPUTER CO., LTD., Shibuya-ku, Tokyo (JP)

(72) Inventor: Satoshi Nishihara, Kodaira (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 226 days.

(21) Appl. No.: 14/540,811

(22) Filed: Nov. 13, 2014

(65) Prior Publication Data

US 2015/0168920 A1 Jun. 18, 2015

(30) Foreign Application Priority Data

Dec. 18, 2013 (JP) ..... 2013-261075

(51) Int. Cl.
*G04G 21/00* (2010.01)
*G04G 21/04* (2013.01)

(52) U.S. Cl.
CPC ..... *G04G 21/04* (2013.01); *G04G 21/00* (2013.01)

(58) Field of Classification Search
CPC ..... G04G 21/04; G04G 21/00; G04G 21/08; H04N 21/47205; G04F 3/00; G01B 5/00
USPC ..... 368/15–20
See application file for complete search history.

(56) References Cited

U.S. PATENT DOCUMENTS 5,696,704 A * 12/1997 Semrau ..... G01D 3/024 324/166
6,965,801 B2 * 11/2005 Hall ..... G04G 15/006 368/14
7,505,911 B2 * 3/2009 Roth ..... G10L 15/22 379/88.03

(Continued)

FOREIGN PATENT DOCUMENTS

JP 2003066168 A 3/2003
JP 2004112392 A 4/2004

(Continued)

OTHER PUBLICATIONS

Machine Translation—JP 2003-66168—dossier1.j-platpat.inpit.go.jp—Aug. 19, 2016.*

(Continued)

*Primary Examiner* — Sean Kayes
(74) *Attorney, Agent, or Firm* — Holtz, Holtz & Volek PC

(57) ABSTRACT

An electronic timepiece, including: a first operation unit; a first communication unit; and a first control unit, wherein one of the plurality of the operation receiving units is a function switching operation receiving unit, i) when a first input signal is input, the first control unit assigns the operation receiving units including the function switching operation receiving unit as external device operation receiving units according to predetermined operation processing to be executed by the external device, ii) when an input operation to the operation receiving units is detected, the first control unit transmits an operation request according to the operation processing corresponding to the input operation to the external device via the first communication unit, and iii) when a second input signal is input, the first control unit ends assignment of the operation receiving units as the external device operation receiving units.

6 Claims, 9 Drawing Sheets

(56) References Cited

U.S. PATENT DOCUMENTS

| | | | | |
|---|---|---|---|---|
| 2009/0295616 | A1* | 12/2009 | Martin | A01K 15/021 341/176 |
| 2015/0153810 | A1* | 6/2015 | Sasidharan | G06F 1/3212 713/320 |
| 2015/0312636 | A1* | 10/2015 | Demerchant | H04N 21/4345 725/47 |

FOREIGN PATENT DOCUMENTS

| | | | |
|---|---|---|---|
| JP | 2005217463 | A | 8/2005 |
| JP | 2009118474 | A | 5/2009 |
| JP | 2013130562 | A | 7/2013 |

OTHER PUBLICATIONS

Machine Translation—JP 2005-217463—dossier1.j-platpat.inpit.go.jp—Aug. 19, 2016.*

Japanese Office Action (and English translation thereof) dated Dec. 8, 2015, issued in counterpart Japanese Application No. 2013-261075.

* cited by examiner

ELECTRONIC TIMEPIECE AND OPERATION SETTING SWITCHING SYSTEM

BACKGROUND OF THE INVENTION

1. Field of the Invention

The present invention relates to an electronic timepiece and an operation setting switching system.

2. Description of Related Art

Conventionally, there have been electronic timepieces which have various functions and can perform the functions by selectively switching between them or performing them in parallel. Many of the electronic timepieces are used by assigning operation receiving units such as a part of operation keys and push buttons to operation instructions which are set for respective operations. In a case where the number of the operation receiving units is not sufficient compared to the number of types of the operations, many operations can be performed by combining operations to a plurality of operation receiving units and identifying an operation method such as long pressing of a button and continuous operation.

For example, Japanese Patent Laid-Open Publication No. 2004-112392 describes a technique for a mobile phone to which an option unit can be attached, the technique being for switching and setting processing contents according to an operation to a predetermined operation key corresponding to the attached option unit.

On the other hand, there have been techniques for remote control of operations according to operation functions of an electronic timepiece via wireless communication from a wristwatch. Japanese Patent Laid-Open Publication No. 2009-118474 describes a technique for switching an operation mode of a wristwatch by an instruction from a mobile phone when performing a shutter operation in a camera function of the mobile phone by the wristwatch via communication by Bluetooth (registered trademark).

However, in each of the electronic devices such as electronic timepieces, especially electronic wristwatches which cannot have many operation receiving units and are not suitable for complicated operations, an operation receiving unit for switching functions is conventionally provided exclusively so as to be able to switch the functions promptly. Accordingly, the number of operation receiving units which can be used for operations according to each of the function modes is reduced for the exclusive operation receiving unit, and furthermore, the type of the operations is restricted and combination of a plurality of operations is cumbersome.

The present invention relates to an electronic timepiece and an operation setting switching system which enables more various function operations without losing operational convenience.

SUMMARY OF THE INVENTION

According to one aspect of the present invention, there is provided an electronic timepiece, including: a first operation unit which has a plurality of operation receiving units and outputs an input signal corresponding to an input operation to the operation receiving units; a first communication unit which communicates with an external device to receive an input signal and transmit an output signal; and a first control unit which performs operation control corresponding to an input signal, wherein one of the plurality of the operation receiving units is a function switching operation receiving unit for selecting and switching any one of a plurality of function modes which are executable by the first control unit, when a first input signal is input, the first control unit assigns the operation receiving units including the function switching operation receiving unit as external device operation receiving units according to predetermined operation processing to be executed by the external device, when an input operation to the operation receiving units assigned as the external device operation receiving units is detected, the first control unit transmits an operation request according to the operation processing corresponding to the input operation to the external device via the first communication unit, and when a second input signal is input, the first control unit ends assignment of the operation receiving units as the external device operation receiving units.

BRIEF DESCRIPTION OF THE DRAWINGS

The above and other objects, advantages and features of the present invention will become more fully understood from the detailed description given hereinafter and the appended drawings which are given by way of illustration only, and thus are not intended as a definition of the limits of the present invention, and wherein.

DETAILED DESCRIPTION OF THE PREFERRED EMBODIMENT

Hereinafter, embodiments of the present invention will be described on the basis of the drawings.

Figure 1:
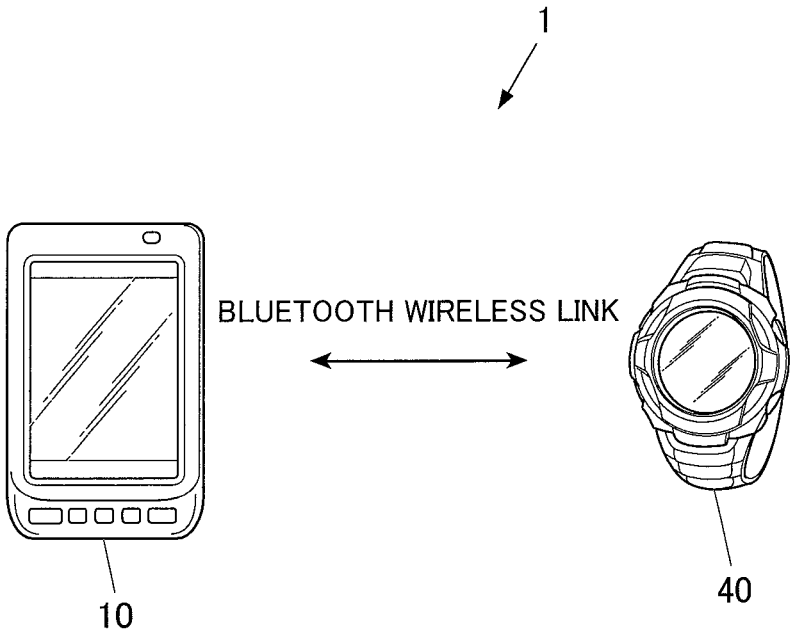
FIG. 1 is an entire view of an operation setting switching system in an embodiment of the present invention.

FIG. 1 is an entire view of an operation setting switching system 1 in an embodiment of the present invention.

The operation setting switching system 1 is configured by including a smartphone 10 as an external device which is an operation target and an electronic wristwatch 40 as an electronic timepiece in which switching of operation setting is performed. Intercommunication via Bluetooth (registered trademark) is possible between the smartphone 10 and the electronic wristwatch 40.

Figure 2:
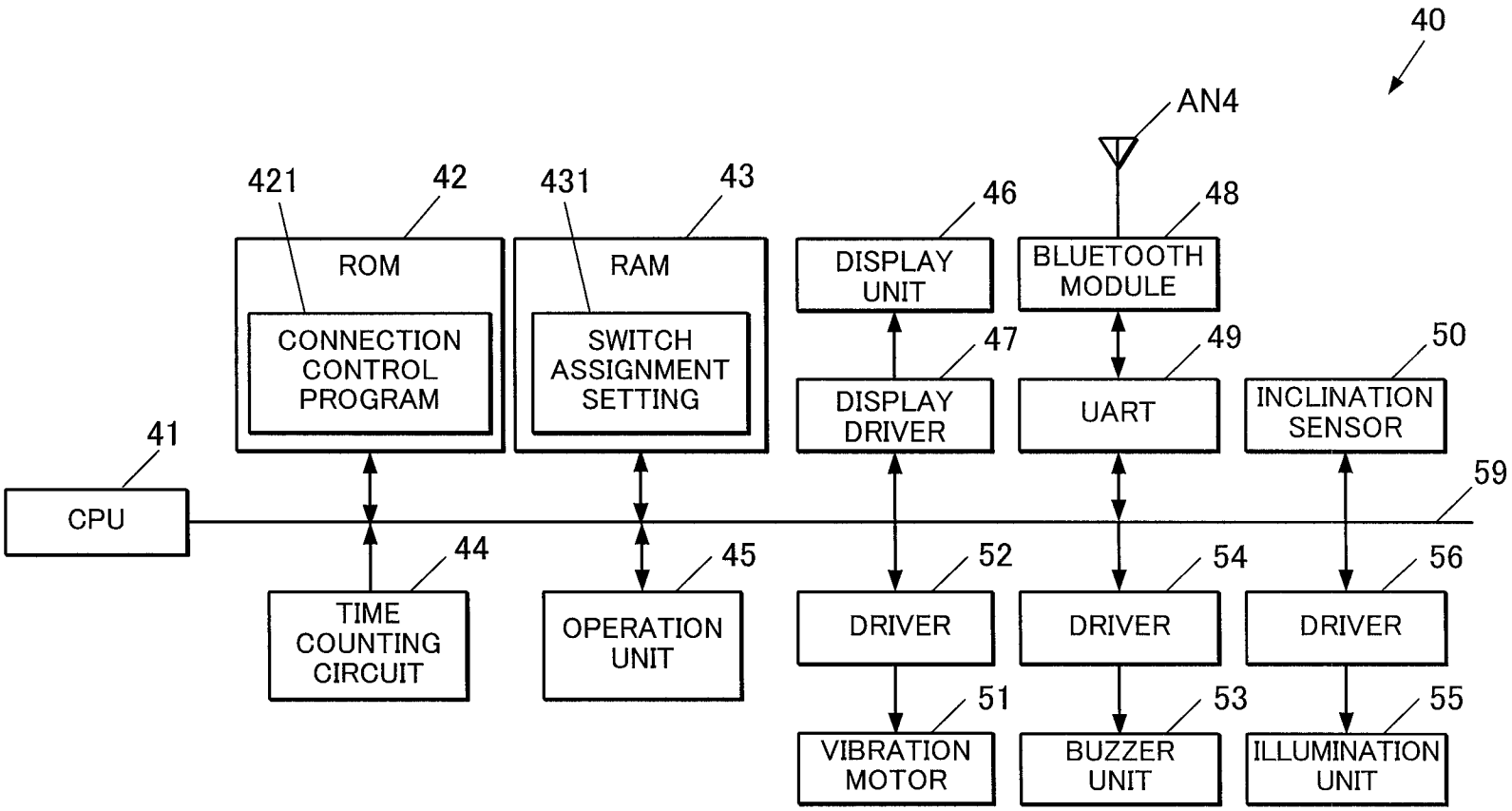
FIG. 2 is a block diagram showing an internal configuration of an electronic wristwatch.

FIG. 2 is a block diagram showing the internal configuration of the electronic wristwatch 40.

The electronic wristwatch 40 is wearable around arms of a user by a band. The electronic wristwatch 40 includes a CPU (Central Processing Unit) 41 (first control unit), a ROM (Read Only Memory) 42, a RAM (Random Access Memory) 43, a time counting circuit 44, an operation unit 45

(first operation unit), a display unit 46, a display driver thereof 47, a Bluetooth module 48, an antenna thereof AN4, a UART (Universal Asynchronous Receiver/Transmitter) 49, an inclination sensor 50, a vibration motor 51, a driver thereof 52, a buzzer unit 53, a driver thereof 54, an illumination unit 55, a driver thereof 56, a bus 59 and such like.

The CPU 41 performs various arithmetic processing and integrally controls the entire operation of the electronic wristwatch 40. The CPU 41 reads out various control programs according to operations of the electronic wristwatch 40 from the ROM 42 and executes the control programs.

The various control programs and initial setting data according to the operations of the electronic wristwatch 40 are stored in the ROM 42. The control programs include an operation setting program for performing assignment setting of processing corresponding to the operation of each push button switch in the operation unit 45, and a connection control program 421 for performing the Bluetooth communication with the smartphone 10.

The RAM 43 provides a working memory space to the CPU 41 and stores data temporarily. The temporal data stored in the RAM 43 includes a current function mode of the electronic wristwatch 40, switch assignment setting 431 which is data determining the assignment setting of each of the push button switches in the function mode, and such like.

The time counting circuit 44 is a counter keeping the current time by counting predetermined frequency signals input from an oscillation circuit (not shown in the drawings) and adding the counted value to the initial time data. Alternatively, the time counting circuit 44 may store the current time which is counted by software by the control of the CPU 41.

The operation unit 45 has a plurality of operation receiving units such as, here, five push button switches B1 to B5 (operation receiving units and external device operation receiving units) which receive input from outside, and the operation unit 45 generates an electrical signal corresponding to the input operation to each of the operation receiving units by the user and outputs the electrical signal as an input signal to the CPU 41.

The display unit 46 includes a display screen 46*a* such as an LCD (Liquid Crystal Display), and displays an operation mode of the electronic wristwatch 40 and various setting menus in accordance with a driving signal from the display driver 47. Though not especially limited, the display screen 46*a* is provided with a region which allows dot matrix type display and a region which allows segment type display.

Figure 3:
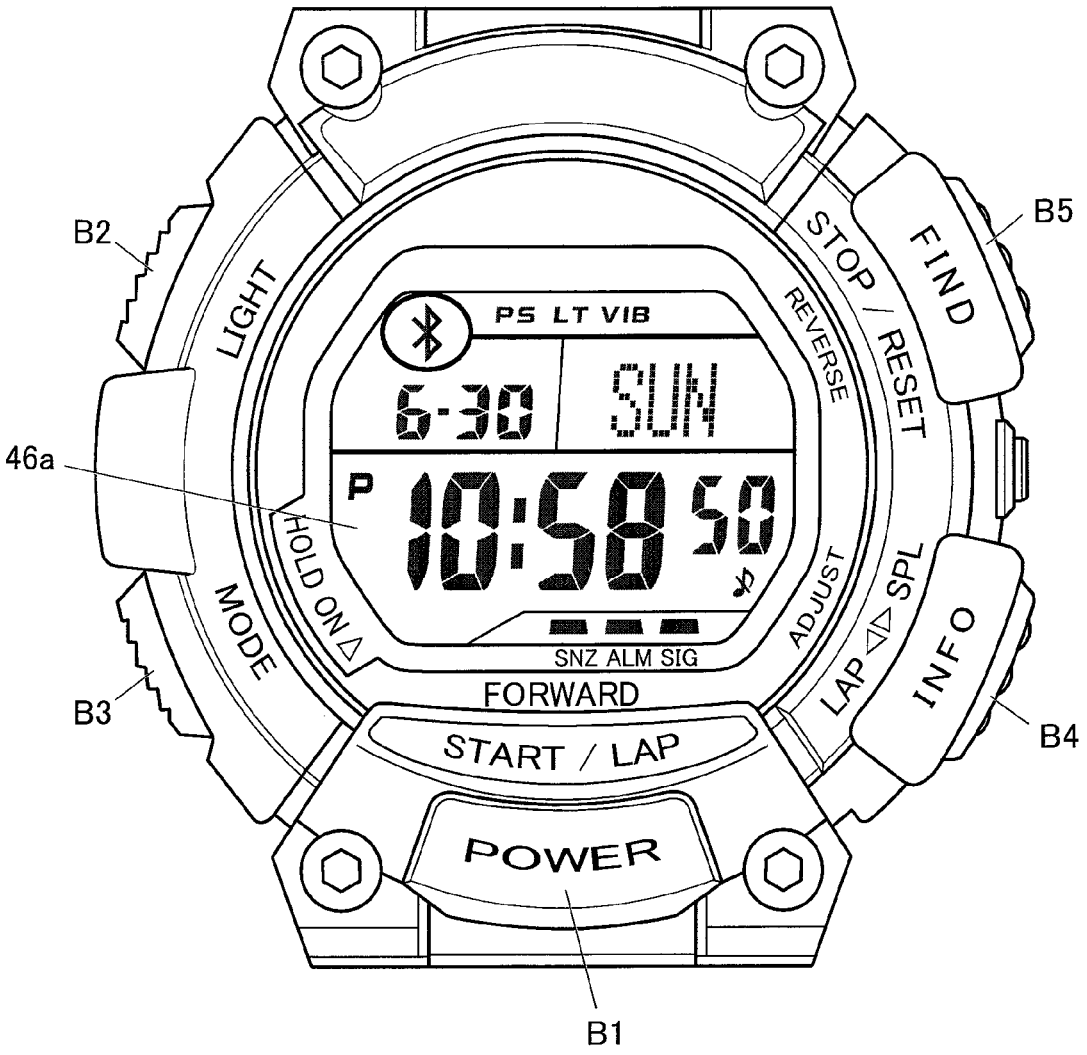
FIG. 3 is a plan view of the electronic wristwatch.

FIG. 3 is a plan view showing the display screen 46*a* of the electronic wristwatch 40 and the push button switches B1 to B5.

In the electronic wristwatch 40, the central display screen 46*a* is divided into a plurality of display regions. Among the plurality of display regions, the segment type display is performed in the lower display region and the upper left display region, and the dot matrix type display is performed in the upper right display region. In addition to the regions, the upper left part has a region provided with a mark indicating the Bluetooth communication, and the lower right part has an indicator indicating on/off of each function. In the segment type display region, display is performed mainly for numbers such as time and date, time to be counted by a stopwatch or a timer and alarm setting time; however, the display is not limited to them depending on the function mode. The dot matrix type display region is used as a priority when displaying various characters such as alphabet characters and symbols; however, number display can also be performed in the dot matrix type display region.

The push button switch B1 is provided at the lower side of the display screen 46*a* on the front surface (surface provided with the display screen 46*a*) of the electronic wristwatch 40 so that the power of the Bluetooth communication is switched between on and off by the push button switch B1 in a function mode according to the normal time display, that is, a basic clock mode. The push button switches B2 to B5 are longitudinally provided on left and right lateral surfaces with respect to the display screen 46*a* of the electronic wristwatch 40 so that two push button switches are provided on each of the surfaces. The push button switches B2 and B3 are provided on the lateral surface at the left side with respect to the display screen 46*a*. The push button switch B2 is provided with a mark "LIGHT" and outputs a control signal for turning on the illumination unit 55 to the driver 56 by being pressed down in the basic clock mode. The push button switch B3 (function switching operation receiving unit) is provided with a mark "MODE" to be a switch for switching function mode and switches between the function modes executable by the electronic wristwatch 40 in a preset order by being pressed down in the modes other than the control mode.

On the other hand, the push button switches B4 and B5 are provided on the lateral surface at the right side with respect to the display screen 46*a*. The push button switch B4 is provided with a mark "INFO" and displays the last incoming information to the smartphone 10 obtained from the smartphone 10 via the Bluetooth communication by being pressed down in the basic clock mode. The push button switch B5 is provided with a mark "FIND", and by being pressed down continuously for a predetermined period of time, for example, three seconds in the basic clock mode, the push button switch B5 makes the external device which is in communication connection thereto via the Bluetooth, that is, the smartphone 10 perform a predetermined notification operation to notify the location of the smartphone 10. The push button switches B4 and B5 are also used for start, end and reset of time measurement and obtaining lap time and split time in a mode according to the stopwatch function.

The Bluetooth module 48 is a control module for performing the Bluetooth communication with an external device such as the smartphone 10 via the antenna AN4. The transmitted data transmitted from the CPU 41 is transmitted from the Bluetooth module 48 to the external device after processing such as serial/parallel conversion at the UART 49. The received data received by the antenna AN4 and the Bluetooth module 48 is output to the CPU 41 after processing such as serial/parallel conversion at the UART 49.

The Bluetooth module 48 and the antenna AN4 form a first communication unit.

The inclination sensor 50 detects whether the electronic wristwatch 40 is inclined in a predetermined direction, and outputs a signal indicating on/off to the CPU 41. As the inclination sensor 50, there can be used various known configurations which can detect a state in which the lower section of the display screen 46*a* is inclined to be lower than the upper section, for example. In such case, the inclination sensor 50 does not need to measure the inclination angle itself.

The vibration motor 51, the buzzer unit 53 and the illumination unit 55 generate vibration, beep sound and light according to drive signals from the drivers 52, 54 and 56, respectively. The vibration motor 51 is a rotation motor, for example. As the buzzer unit 53, a piezoelectric element such as PZT can be used, for example. As the illumination unit 55, a luminous body such as an LED with low power consumption is used.

The vibration motor 51 and the buzzer unit 53 are used for various notification operations. The notification by vibration (vibration setting, VIB) and notification by buzzer sound are appropriately used in parallel or selectively switched to each other on the basis of the user setting.

The illumination unit 55 is normally turned on for a predetermined period of time by the pressing operation of the push button switch B2. When the push button switch B2 is not set to correspond to the processing according to the illumination during control mode or such like, or when the push button switch B2 is separately set in the setup mode, the illumination unit 55 is operated in an auto light mode (LT) in which the illumination unit 55 is automatically turned on for a predetermined period of time on the basis of the inclination state measured by the inclination sensor 50.

The CPU 41 and other units in the embodiment are driven by electric power supplied from the power source unit which is not shown in the drawings. A preferred battery of the power source unit is a battery which is small and light and can supply electric power stably for a long period of time, and a button type primary cell in a compact disc shape is used, for example. Alternatively, the solar electric generation unit and secondary cell may be combined as the battery, or the battery may be used with a primary cell.

Figure 4:
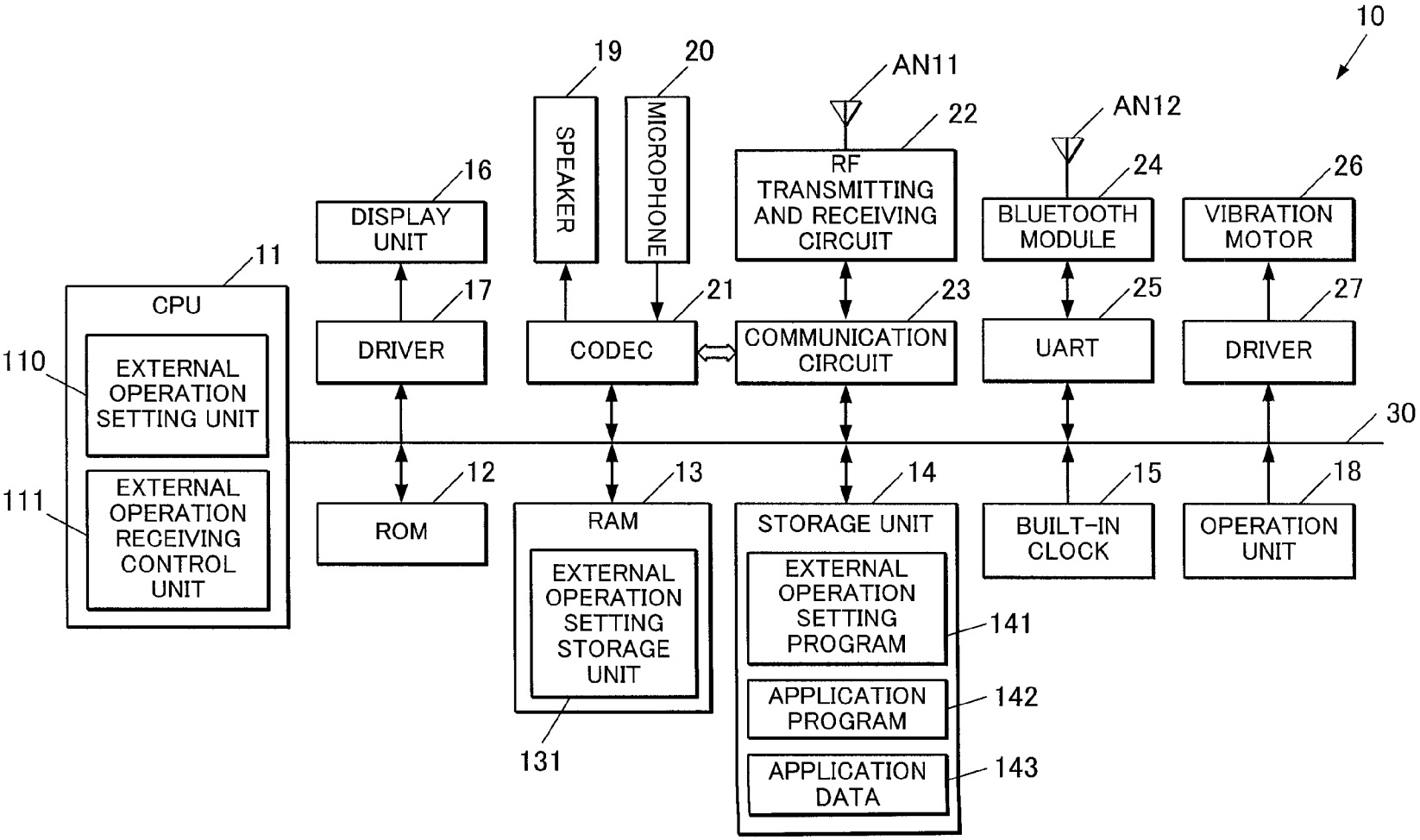
FIG. 4 is a block diagram showing an internal configuration of a smartphone.

FIG. 4 is a block diagram showing the internal configuration of the smartphone 10.

The smartphone 10 includes a CPU 11 (second control unit) including an external operation setting unit 110 and an external operation receiving control unit 111, a ROM 12, a RAM 13, a storage unit 14, a built-in clock 15, a display unit 16 (display unit), a driver thereof 17, an operation unit 18 (second operation unit), a speaker 19, a microphone 20, a codec 21, an RF transmitting and receiving circuit 22, a radio wave transmitting and receiving antenna for mobile phone communication AN11, a communication circuit 23, a Bluetooth module 24, a UART 25, a radio wave transmitting and receiving antenna of Bluetooth communication AN12, a vibration motor 26, a driver thereof 27, a bus 30 and such like. The external operation setting unit 110 and the external operation receiving control unit 111 may be separated by providing a plurality of CPUs 11, and such like.

The CPU 11 performs various types of arithmetic processing and integrally controls the entire operation of the smartphone 10. The CPU 11 executes various application programs (applications) which are installed in the storage unit 14.

The ROM 12 stores various control programs to be executed by the CPU 11 and initial setting data. The ROM 12 may be a non-volatile memory which is partially or entirely writable.

The RAM 13 is a volatile memory for providing a working memory space to the CPU 11 and storing temporal data for work.

The storage unit 14 is a non-volatile memory which is readable and writable such as a flash memory and an EEPROM (Electrically Erasable and Programmable Read Only Memory), for example. The storage unit 14 stores various application programs 142 (applications) to be executed by the CPU 11 and various application data 143 to be used for the application programs 142. The CPU 11 reads out a necessary application and data based on the instruction according to the input operation by a user, and executes the processing (predetermined operation processing). As an application stored in the storage unit 14, for example, there are a music application for playing a music software and such like, a running application for managing a running speed and distance of the user, a calorie consumption management application of the user and other various applications. The application also includes an external operation setting program 141 for receiving an operation of another application program under execution by an input operation to the electronic device which is in communication connection via the Bluetooth.

The built-in clock 15 is a counter for counting and maintaining the current time. The smartphone 10 reads out the current time and displays the current time on the display unit 16. The current time data is compared with set time data according to various functions to perform various operations. When the smartphone 10 is activated, the current time data of the built-in clock 15 is read out from the RTC (Real Time Clock) and set as an initial value of the counter. The current time data is corrected by time data obtained from a base station whenever necessary when the mobile phone communicates with the base station by the RF transmitting and receiving circuit 22.

The display unit 16 includes an LCD (Liquid Crystal Display) as the display screen 16*a*, for example. The driver 17 (liquid crystal driver) which is operated by the control signal transmitted from the CPU 11 drives the LCD to perform display according to various functions of the smartphone 10. The display unit 16 may include a display screen 16*a* in another display style, for example, an organic ELD (Electro-Luminescent Display), and the driver 17 is appropriately selected according to the display type of the display screen 16*a*.

The operation unit 18 which includes a touch sensor detects the touch operation position and operation contents of the user on the LCT screen of the display unit 16, generates an electrical signal according to the operation and outputs the signal as an input signal to the CPU 11. The operation unit 18 may further include one or a plurality of operation keys and switches so that the user outputs an input signal based on the user's operation with respect to the operations keys and switches to the CPU 11.

The speaker 19 converts an electrical signal into an audio signal on the basis of the signal from the codec 21 and outputs the sound. The microphone 20 detects sound waves to convert them into an electrical signal and outputs the electrical signal to the codec 21. The codec 21 decodes a digital audio signal which is encoded and compressed to transmit the decoded signal to the speaker 19 as an analog signal, and encodes the audio signal obtained from the microphone 20 to output the encoded signal to the CPU 11 and the communication circuit 23. A speaker for telephone calls and a speaker for outputting notification sound and such like to outside may be separately provided. The audio output can be output not only to the speaker 19 but also to an earphone jack which is not shown in the drawings. As mere audio output for notification operation, a buzzer generation unit may be provided to output beep sound by vibrating a piezoelectric element, for example.

The RF transmitting and receiving circuit 22 uses the antenna AN11 to perform transmitting and receiving processing of telephone communication data and mail communication data with a communication base station of the mobile phone. The communication circuit 23 performs various processing according to transmitted and received data which are transmitted and received by the RF transmitting and receiving circuit 22 and performs data passing with the CPU 11 and the codec 21.

The Bluetooth module 24 is the control module for performing the Bluetooth communication with the external device such as the electronic wristwatch 40 via the antenna AN 12. The transmitted data transmitted from the CPU 11 is transmitted from the Bluetooth module 24 to the external device via processing such as serial/parallel conversion by the UART 25. The received data received from the external device by using the Bluetooth module 24 is output to the CPU 11 as the input signal via processing such as parallel/serial conversion by the UART 25.

The Bluetooth module 24 and the antenna AN12 form the second communication unit.

The vibration motor 26 is for notifying the user by generating vibrations. When the control signal is transmitted from the CPU 11 to the driver 27, the driver 27 converts the control signal into a voltage signal necessary for operating the vibration motor 26 and outputs the voltage signal. As the vibration motor 26, a rotation motor is used, for example.

For the power source of the smartphone 10, a rechargeable lithium ion battery is used, for example.

For the RF transmitting and receiving circuit 22 and the Bluetooth module 24, the on/off of the power supply can be controlled individually, separately from the power operation of the entire smartphone 10.

Next, switching of function mode in the electronic wristwatch 40 in the embodiment will be described.

Figure 5:
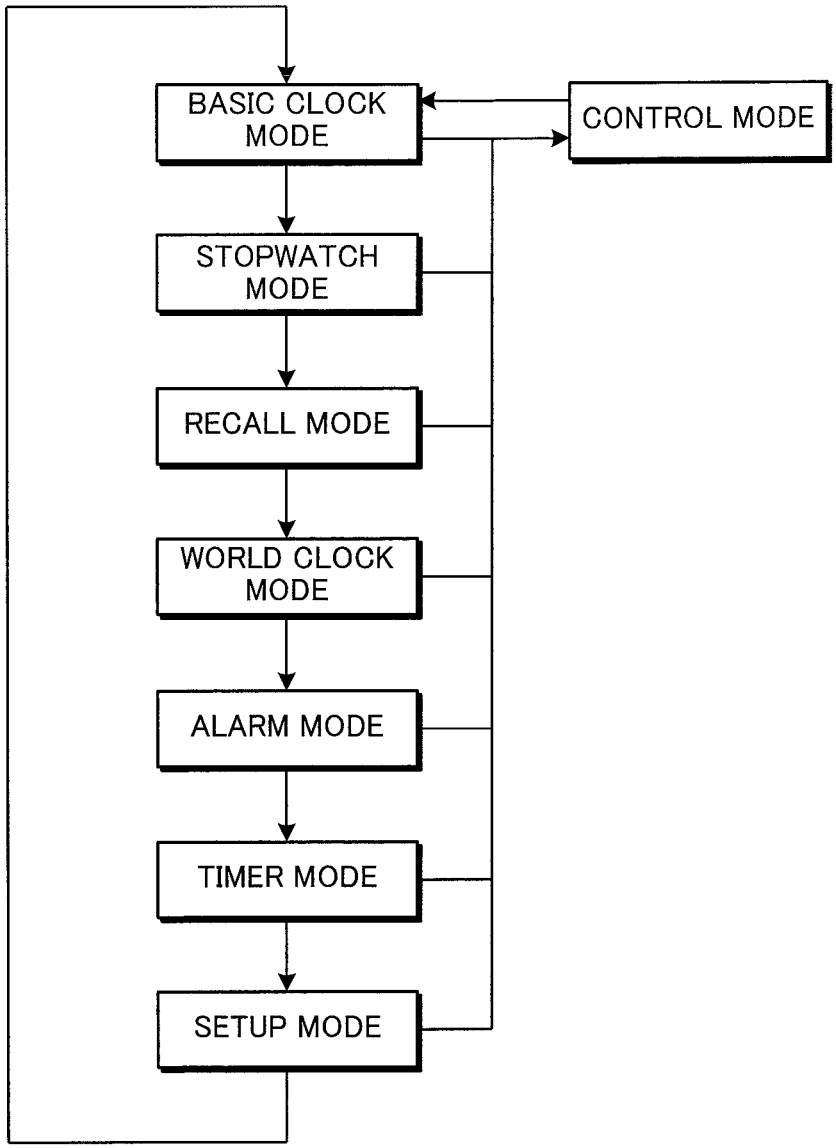
FIG. 5 is a view for explaining switching between function modes executable by the electronic wristwatch.

FIG. 5 is a view for explaining the switching order of function mode in the electronic wristwatch 40.

Normally, the electronic wristwatch 40 operates in the basic clock mode (function mode according to normal time display) for displaying the current time at the set current position. When the push button switch B3 is pressed down, as shown by the arrows, the mode is switched to the stopwatch mode, the recall mode, the world clock mode, alarm mode, timer mode and setup mode in order for each pressing operation, and when the push button switch B3 is pressed down again, the mode returns to the basic clock mode.

Here, the stopwatch mode is a mode for measuring elapsed time by a user, and the recall mode is for recalling and displaying, in order, the time (including lap time and split time) which is measured in the stopwatch mode and stored in the RAM 13. The world clock mode is a mode for displaying time at a time zone to which a city belongs by setting the city in the world. The alarm mode is for setting on/off of alarm notification and setting the time when the alarm notification is to be performed. The timer mode is a mode for counting the set time and notifying that the time has elapsed. The setup mode is a mode for performing setting according to various operations of the electronic wristwatch 40.

In addition to the operation of switching between the function modes in order, an operation of directly switching to the control mode from any function mode is performed by a predetermined input signal (first input signal) in the electronic wristwatch 40 in the embodiment. The control mode is shifted to the basic clock mode by a predetermined input signal (second input signal). In the electronic wristwatch 40 in the embodiment, an input signal according to a switching request from the external device in communication connection thereto via the Bluetooth is used as the predetermined input signal.

Here, in the electronic wristwatch 40 of the embodiment, during a control mode according to an application, the control mode is directly switched to a control mode according to another application when a shift instruction to shift to the control mode according to the another application is obtained.

Next, a switching operation for operation setting of the electronic wristwatch 40 in the embodiment will be described.

Figure 6A:
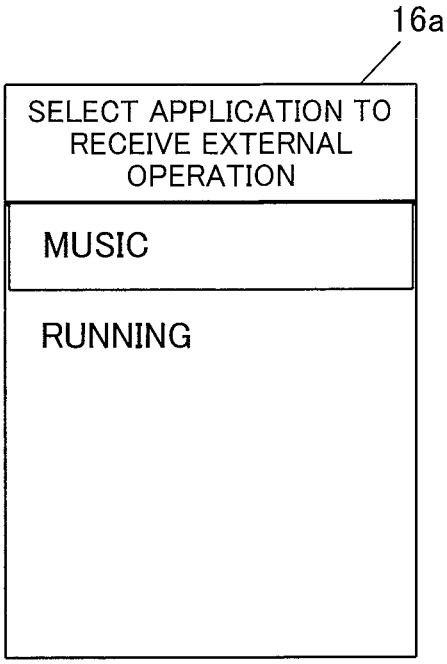
FIGS. 6A and 6B are views showing display screens according to operation setting switching of the electronic wristwatch.
Figure 6B:
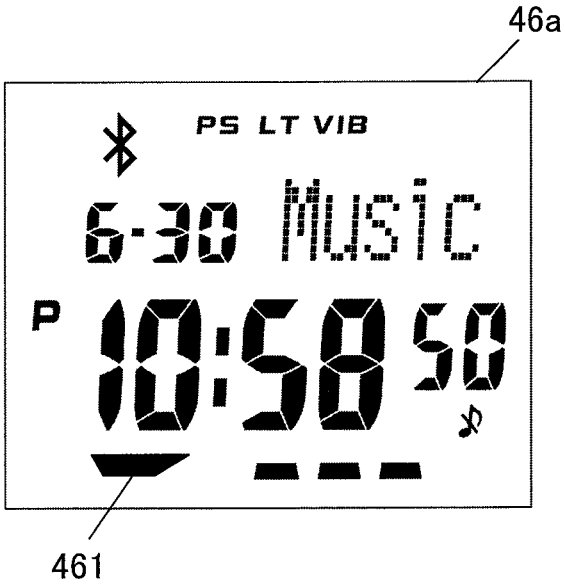

FIGS. 6A and 6B are views showing display screens according to switching of the operation setting of the electronic wristwatch 40 in the embodiment.

FIG. 6A is a view showing an example of a selection screen for external operation setting displayed on the display screen 16*a* of the smartphone 10.

The operation setting of the electronic wristwatch 40 in the embodiment is performed in the smartphone 10 by the user performing or cancelling the setting to receive the external operation in an application activated in the smartphone 10. Here, "MUSIC" application and "RUNNING" application are activated and able to be selected to receive the external operation. Here, when the user taps (touches) the displayed part of the "MUSIC" application to select the application and thereby the signal according to the selection is input from the operation unit 18 to the CPU 11, for example, the CPU 11 transmits a request for shifting to the control mode according to the "MUSIC" application to the electronic wristwatch 40 via the Bluetooth module 24. When the request is received at the electronic wristwatch 40, the CPU 41 shifts the operation setting of the push button switches B1 to B5 to the control mode according to the "MUSIC" application in the smartphone 10.

FIG. 6B is a view showing a display example of the display screen 46*a* when the operation setting is shifted to the control mode according to the "MUSIC" application.

When the operation setting is shifted to the control mode, the horizontal segment 461 at the lower left section of the display screen 46*a* is lighted to indicate the control mode. The "MUSIC" is displayed in the dot matrix display region at the upper right section of the display screen 46*a* to indicate that the "MUSIC" application can be operated. In this state, for example, Play and Pause are alternately set to the push button switch B1 and Next and Previous are set to the push button switches B4 and B5, respectively, and increase and decrease in sound volume are respectively set to the push button switches B2 and B3.

While playing a music, scroll display of the music title can be performed in the dot matrix display region.

Settings according to the assignment of the push button switches B1 to B5 are stored in the switch assignment setting 431 so as to be associated with each type of the applications. Though the switch assignment setting 431 is not especially limited, the user can customize the switch assignment setting 431 by the setting operation in the smartphone 10. When external operation setting is performed according to an application, the setting is transmitted from the smartphone 10 to the electronic wristwatch 40 to be stored as the switch assignment setting 431 in the RAM 43.

Figure 7A:
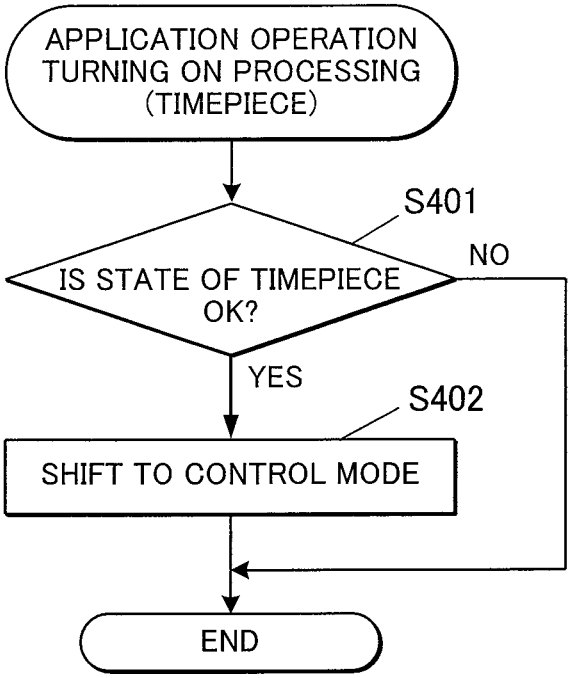
FIGS. 7A and 7B are flowcharts showing control procedures of application operation on/off setting processing of a smartphone.
Figure 7B:
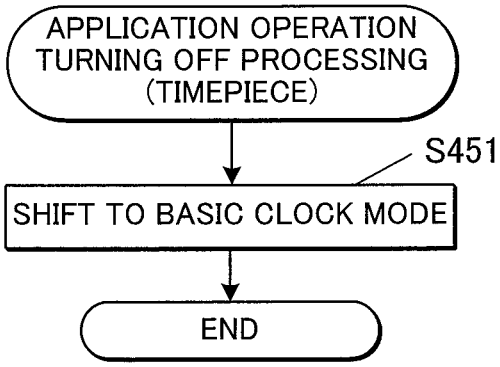

FIGS. 7A and 7B are flowcharts showing control procedures for application on/off setting processing of the smartphone 10 to be executed by the CPU 41 in the electronic wristwatch 40.

FIG. 7A is a flowchart showing a control procedure for processing of shifting to a control mode and turning on an application operation in the electronic wristwatch 40. FIG. 7B is a flowchart showing a control procedure for processing of ending the control mode and turning off the application operation.

The application operation turning on processing in the embodiment is started by obtaining a request for shift to the control mode from the smartphone 10 via the Bluetooth communication. When the application operation turning on processing is started, the CPU 41 determines whether the electronic wristwatch 40 can shift to the control mode (step S401). If it is determined that the electronic wristwatch 40 can shift to the control mode (step S401; YES), the CPU 41 shifts to the control mode and changes the assignment setting according to the received contents received at the push button switches B1 to B5 to the switch assignment setting corresponding to the application information obtained via the Bluetooth communication (step S402). Then, the CPU 41 ends the application operation turning on processing. If it is not determined that the electronic wristwatch 40 can shift to the control mode (step S401; NO), the CPU 41 directly ends the application operation turning on processing. When the processing follows the arrow "NO" in the determination processing of step S401, the processing of step S401 may be repeated for a predetermined period of time to standby until the electronic wristwatch 40 becomes able to shift to the control mode.

On the other hand, the application operation turning off processing in the embodiment is started by obtaining a request for ending the control mode from the smartphone 10 via the Bluetooth communication. When the application operation turning off processing is started, the CPU 41 ends the control mode and changes the switch assignment setting of the push button switches B1 to B5 to the setting in the basic clock mode (step S451). Then, the CPU 41 ends the application operation turning off processing.

Figure 8:
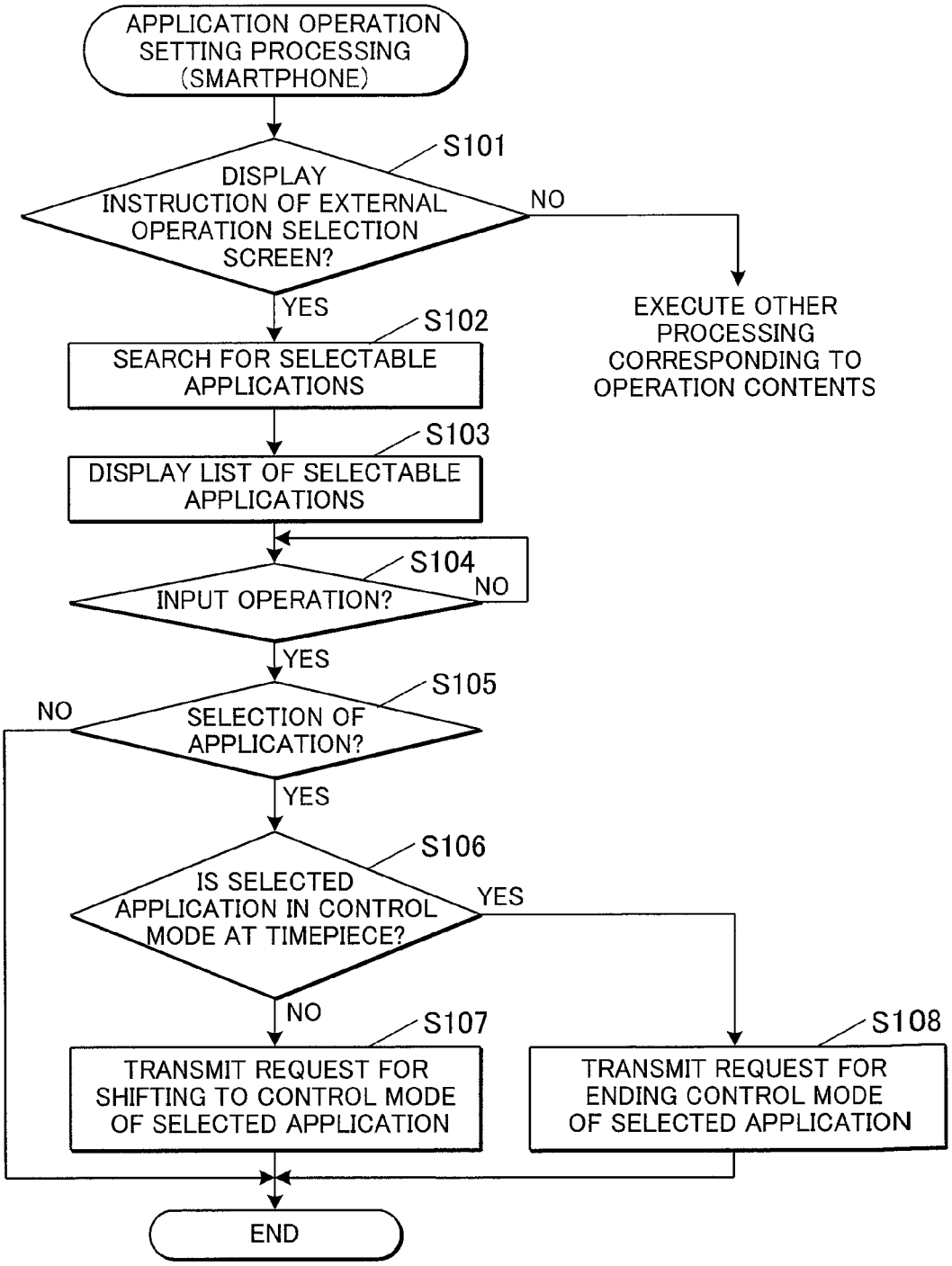
FIG. 8 is a flowchart showing a control procedure of setting processing according to on/off of application operation by the electronic wristwatch executed at the smartphone.

FIG. 8 is a flowchart showing a control procedure of setting processing according to on/off of the application operation in the electronic wristwatch 40 to be executed by the CPU 11 in the smartphone 10.

The application operation setting processing is executed as a part of the application control program in the smartphone 10 when an input operation to the operation unit 18 according to an application is detected.

When the input operation is detected, the CPU 11 determines whether the input operation is according to the display instruction of external operation selection screen, that is, the screen (external operation selection screen) for performing or cancelling the setting for operating the application under execution by input operations to the external electronic wristwatch 40 (step S101).

If it is not determined that the input operation is according to the display instruction of external operation selection screen (step S101; NO), the CPU 11 executes other processing corresponding to the contents of the operation.

If it is determined that the input operation is according to the display instruction of external operation selection screen (step S101; YES), the CPU 11 searches for applications which are currently executed and can receive operations from the external electronic wristwatch 40 (step S102). The CPU 11 displays a list of the applications detected as capable of receiving operations on the display screen of the display unit 16 as shown in FIG. 6A (step S103). Then, the CPU 11 waits for an input operation.

The CPU 11 determines whether an input operation is performed (step S104). If it is not determined that an input operation is performed (step S104; NO), the CPU 11 repeats the processing of step S104.

If is it determined that an input operation is performed (step S104; YES), the CPU 11 determines whether the detected input operation is according to the selection of application (step S105). If it is not determined that the detected input operation is according to the selection of application, that is, here, when the selection is canceled (step s105; NO), the CPU 11 ends the application operation setting processing.

If it is determined that the detected input operation is according to the selection of application (step S105; YES), the CPU 11 determines whether the selected application is currently set in the control mode at the electronic wristwatch 40 which is in communication connection thereto via the Bluetooth communication (step S106). If it is not determined that the selected application is set in the control mode (step S106; NO), the CPU 11 transmits and outputs a request for shifting to the control mode of the selected application to the electronic wristwatch 40 via the Bluetooth module 24 (step S107). At this time, if any other application is in the control mode, the CPU 11 cancels the control mode of the other application at the same time. Then, the CPU 11 ends the application operation setting processing.

If it is determined that the selected application is set in the control mode (step S106; YES), the CPU 11 transmits and outputs the request for ending the control mode to the electronic wristwatch 40 via the Bluetooth module 24 (step S108). Then, the CPU 11 ends the application operation setting processing.

As described above, the electronic wristwatch 40 according to the operation setting switching system 1 in the embodiment includes the operation unit 45 which has a plurality of push button switches B1 to B5 and outputs an input signal corresponding to an input operation to the push button switches B1 to B5, the Bluetooth module 48 and the antenna AN4 which communicate with the smartphone 10 via short-range wireless communication to receive an input signal and transmit an output signal and the CPU 41 which performs operation control according to the input signal. The push button switch B3 among the push button switches B1 to B5 is a switching switch of function mode for selecting and switching one of the plurality of function modes executable by the CPU 41. When an input signal requesting for shift to a control mode is input, the CPU 41 assigns the push button switches B1 to B5 including the push button switch B3 as operation receiving switches for an application to be executed at the smartphone 10. When the operation unit 45 detects an input operation to the push button switches B1 to B5 assigned as the operation receiving switches for the application and inputs the input operation to the CPU 41, the CPU 41 transmits an application operation request corresponding to the input operation to the smartphone 10 via the Bluetooth module 48. When an input signal requesting end of the control mode is input, the CPU 41 ends the assignment of the push button switches B1 to B5 as the operation receiving switches for the application.

Accordingly, more various function operations can be performed without losing convenience of operation even at the electronic wristwatch 40 which has a limited number of push button switches and difficulty in complicated operations. Especially, when operating an external device (smartphone 10) requiring more operations, by temporarily using a function mode switching switch for the operations of the smartphone 10, operations can be complicated by combining operations of push button switches B1 to B5 needed for the operations of the smartphone 10, and the limitations on operable commands can be eased. On the other hand, when the control mode for operating the smartphone 10 is ended, the operation can be easily returned to the normal operation state.

Especially, since each of the input signal requesting shift to the control mode and the input signal requesting end of the control mode is received from the smartphone 10 via the Bluetooth module 48 and the antenna AN4, the user can perform the setting and the operation for cancelling the setting with the smartphone 10 in the operation of an application in the smartphone 10, the setting being for enabling operations of a desired application by operating the electronic wristwatch 40. Thus, the user can easily and surely switch the setting.

While the push button switches B1 to B5 are assigned as the operation receiving switches of an application, when the communication connection with the smartphone 10 via the Bluetooth module 48 is disconnected, the CPU 41 automatically ends the assignment. Accordingly, the original operations of the electronic wristwatch 40 are not disturbed due to the control mode being maintained in a state in which the electronic wristwatch 40 cannot perform application operation of the smartphone 10. It is also possible to avoid duplication of effort that the smartphone 10 performs the end operation of application, the disconnection of the Bluetooth communication or battery off in parallel with the operation of cancelling the assignment.

When the assignment as the operation receiving switches for the application ends, the CPU 41 shifts to the basic clock mode. Accordingly, it is possible to prevent troublesome work for the user to confirm a mode to which the electronic wristwatch 40 returned when the assignment was ended.

The smartphone 10 forming the operation setting switching system 1 includes the Bluetooth module 24 and the antenna AN12 for performing communication via the Bluetooth, the CPU 11 which performs operation control of applications, and the operation unit 18 which receives user's operation. The CPU 11 as the external operation setting unit 110 sets whether to receive a predetermined operation request from the electronic wristwatch 40 for an application under execution. In a case where a predetermined operation request is set to be received from the electronic wristwatch 40, the CPU 11 as the external operation receiving control unit 111 performs operation control of the application according to a received operation request when the operation request is received from the electronic wristwatch 40 via the Bluetooth module 24.

Accordingly, in a case where it is difficult to hold the smartphone 10 by hand for direct operation, for example, during various types of exercise such as running, jogging and climbing, riding a bicycle or a bike, during meeting, or while operating another device or holding baggage, the external operation can be received from the electronic wristwatch 40 more easily and effortlessly to perform operation control.

Furthermore, setting can be easily and surely performed with respect to a desired application since the user can set receiving and cancelling the operation from the electronic wristwatch 40 on the application operation screen of the smartphone 10.

The smartphone 10 further includes the display unit 16. The CPU 11 as the external operation setting unit 110 searches for applications under execution on the basis of the input operation to the operation unit 18 by the user and displays a list of the detected applications on the application operation screen of the smartphone 10 to enable the user to select an application to be set to be able to receive the external operation from the electronic wristwatch 40. Thereby, in a case where the user is executing a plurality of applications and processing in parallel, while performing an operation according to processing, the user can easily change the state of operation according to another processing so as to be able to receive external operations. For example, while reading a text such as a news or creating an e-mail, the user can easily perform setting so that the playing state of music can be operated at the electronic wristwatch 40. The user can also easily exchange the operation target application for the smartphone 10 and the operation target application for the electronic wristwatch 40.

Modification Example

Next, a modification example of an operation according to control mode on/off setting in the electronic wristwatch 40 of the operation setting switching system 1 in the embodiment will be described.

Figure 9A:
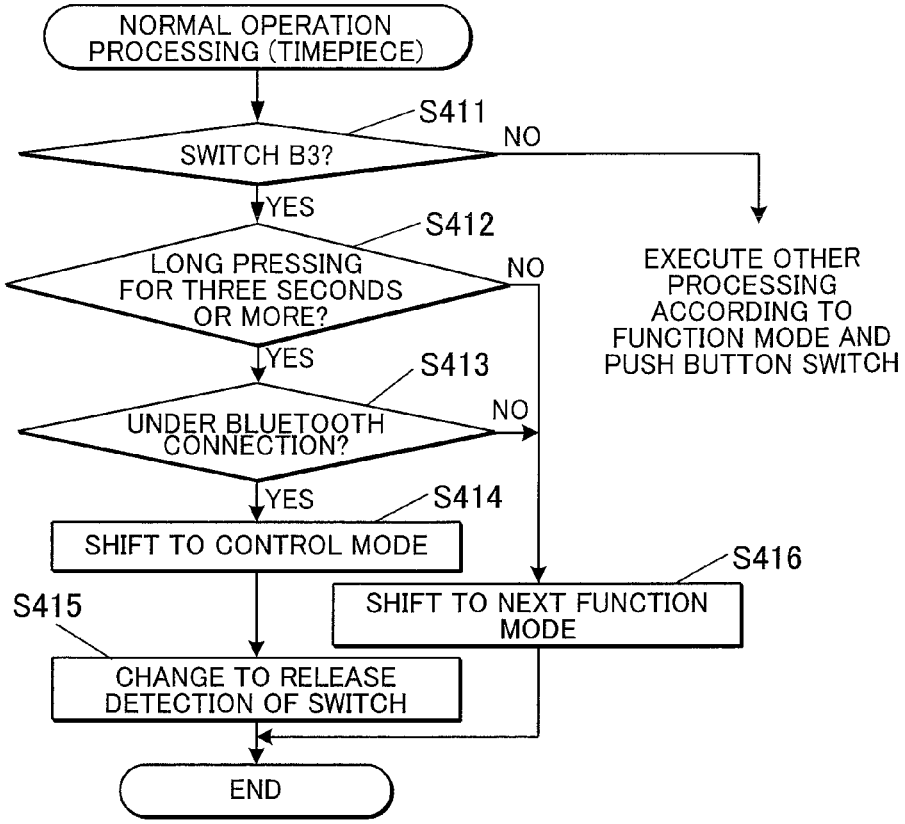
FIGS. 9A and 9B are flowcharts showing control procedures of processing according to control of an input operation to the electronic wristwatch.
Figure 9B:
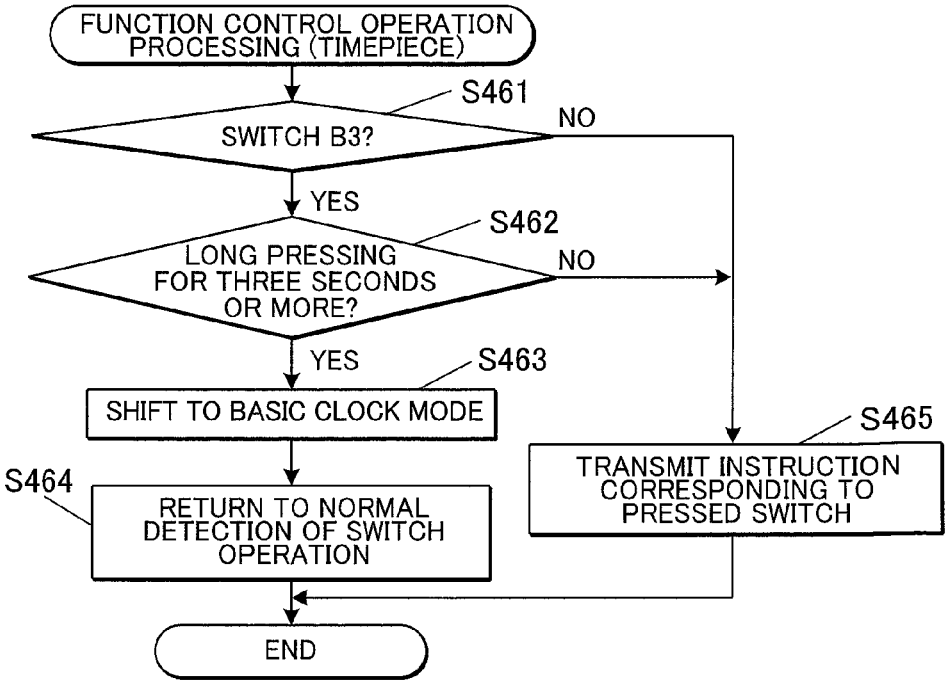

FIGS. 9A and 9B are flowcharts showing control procedures of processing regarding operations of push button switches B1 to B5 to be executed by the CPU 41 in the electronic wristwatch 40 instead of or in addition to the operations according to the on/off setting of the application operation shown in FIGS. 7A and 7B.

FIG. 9A is a flowchart showing a control procedure of normal operation processing to be executed when the pressing of any one of the push button switches B1 to B5 is detected in the normal function modes other than the control mode.

When the normal operation processing is started, the CPU 41 determines whether the pressed push button switch is the push button switch B3 (step S411). If it is not determined that the pressed push button switch is the push button switch B3 (step S411; NO), the CPU 41 executes the processing which is set according to the function mode under execution and the pressed push button switch.

If it is determined that the pressed push button switch is the push button switch B3 (step S411; YES), the CPU 41 determines whether the pressing is the long pressing that the push button switch B3 is continuously pressed down for a predetermined period of time (for example, three seconds) (step S412). If it is not determined that the pressing is the long pressing (step S412; NO), the CPU 41 shifts the function mode which is currently operated to the next function mode (step S416). Then, the CPU 41 ends the normal operation processing.

If it is determined that the pressing is the long pressing (step S412; YES), the CPU 41 determines whether the electronic wristwatch 40 is in communication connection via Bluetooth with the smartphone 10 (step S413). If it is not determined that the electronic wristwatch 40 is in the communication connection (step S413; NO), the processing of the CPU 41 shifts to step S416. If it is determined that the electronic wristwatch 40 is in the communication connection (step S413; YES), the CPU 41 shifts to the control mode according to the application under execution at the smartphone 10 to which the electronic wristwatch 40 is being connected via the Bluetooth (step S414). The CPU 41 obtains information according to the application which is being executed at the smartphone 10 by transmitting a query to the smartphone 10 via the Bluetooth communication. At this time, when a plurality of applications are executed in parallel at the smartphone 10, the electronic wristwatch 40 may shift to the control mode according to the application which was executed previous time or last time, or the smartphone 10 may select an appropriate application on the basis of the history and transmit the setting information to the electronic wristwatch 40, for example. Alternatively, the CPU 41 may not perform selection among the plurality of applications, and may shift to a control mode according to an application only when the single application is executed.

The CPU 41 changes the operation detection of the push button switches B1 to B5 from the detection when the button switch is pressed down to the detection (release detection) when the pressing is ended (step S415). Then, the CPU 41 ends the normal operation processing.

FIG. 9B is a flowchart showing a control procedure by the CPU 41 of the function control operation processing according to the control to be performed when any one of the push button switches B1 to B5 is operated in the control mode.

In the control mode, the operation detection of push button switch is the release detection as described above. Here, the release detection normally indicates detecting the timing when the pressing of the push button switch is released (pressing operation is actually ended); however, as for the long pressing detection, the CPU 41 may determine that the pressing operation for three seconds ended when three seconds elapsed in a state in which the push button switch was pressed down and may start the operation processing corresponding to the long pressing operation.

The CPU 41 determines whether the pressed push button switch is the push button switch B3 (step S461). If it is not determined that the pressed push button switch is the push button switch B3 (step S461; NO), the CPU 41 transmits the instruction which is set according to the pressed push button switch to the smartphone 10 via the Bluetooth module 48 (step S464). Then, the CPU 41 ends the function control operation processing.

If it is determined that the pressed push button switch is the push button switch B3 (step S461; YES), the CPU 41 determines whether the push button switch B3 was pressed down for three seconds, that is, whether the long pressing operation was performed (step S462). If it is not determined that the long pressing operation was performed (step S462; NO), the processing of the CPU 41 shifts to step S465 and the CPU 41 transmits the instruction which is set corresponding to the push button switch B3 to the smartphone 10 via the Bluetooth module 48.

If it is determined that the long pressing operation of the push button switch B3 was performed (step S462; YES), the CPU 41 ends the control mode and shifts to the basic clock mode (step S463). The CPU 41 returns the operation detection of the push button switches B1 to B5 from the release detection to the detection at the timing of pressing (step S464). Then, the CPU 41 ends the function control operation processing.

In the control mode, when the connection with the smartphone 10 via the Bluetooth communication is disconnected, the CPU 41 can execute the processing of shifting to the basic clock mode after standby for a predetermined period of time. When the application which is set to receive the external operation is ended at the smartphone 10, the CPU 11 returns the operation setting of the electronic wristwatch 40 to the normal basic clock mode by requesting the electronic wristwatch 40 to end the control mode via the Bluetooth module.

As described above, in the modification example of the operation according to the on/off setting in the control mode of the electronic wristwatch 40 in the operation setting switching system 1, since each of the input signals requesting the shift to the control mode and end of the control mode in the electronic wristwatch 40 is a signal which is output from the operation unit 45 by detecting the long pressing operation of the push button switch B3, the on/off of the control mode can be switched even at the electronic wristwatch 40. Accordingly, even when the user is already unable to directly operate the smartphone 10, the user can operate, by the electronic wristwatch 40, the application which is being executed at the smartphone 10. Also, when the user intends to perform other operations at the electronic wristwatch 40, the user can easily end or interrupt the control mode by operating the electronic wristwatch 40 without operating the smartphone 10.

Since the operation detection of the push button switches B1 to B5 is the release detection during the control mode, in a case where the user intends to end the control mode, it is possible to prevent the operation request according to the operation of the push button switch B3 from being transmitted to the smartphone 10 at the timing when the push button switch B3 is pressed down.

The present invention is not limited to the above embodiments and various changes can be made.

For example, the embodiment is described by citing the five push button switches B1 to B5 as an example of the operation receiving units; however, the operation receiving units may include other things such as a crown and a touch sensor, for example. In this case, instead of the long pressing for three seconds shown in FIGS. 9A and 9B, continuous rotation of the crown for a predetermined angle or more and double tap may be detected after a predetermined period of time has elapsed since the rotation operation and the tapping operation was performed.

Though the operation according to the shift request to the control mode and the operation according to the end of the control mode are the same operation in the embodiment, the operations may be different from each other.

The embodiment is described by showing an example in which a list of applications to receive the operation request from the electronic wristwatch 40 among applications which are being executed at the smartphone 10 is displayed so as to be selectable; however, in a case where the electronic wristwatch 40 and the smartphone 10 are in communication connection with each other via the Bluetooth while a predetermined software is activated, the electronic wristwatch 40 may automatically shift to the control mode according to this application. On the other hand, the electronic wristwatch 40 may enable the user to set not to shift to the control mode automatically.

In the embodiment, the operation contents corresponding to the push button switches B1 to B5 are stored as the switch assignment setting 431 in the electronic wristwatch 40 and the operation contents are transmitted to the smartphone 10. However, the electronic wristwatch 40 may not store and maintain the switch assignment setting 431, and only the information of the pressed push button switch may be transmitted to the smartphone 10 so that the CPU 11 translates the information into the requested operation contents to perform operation processing at the smartphone 10. However, the electronic wristwatch 40 needs to obtain at least information regarding which push button switches are to be shifted to the control mode in a case where the number of push buttons necessary for an application operation to be selected and the type of the operation vary depending on the application, especially in a case where there are both applications requiring the push button switch B3 to shift to the control mode and applications not requiring the shift of the push button switch B3 to the control mode.

In the embodiment, when the communication connection between the electronic wristwatch 40 and the smartphone 10 is disconnected during application operation by the electronic wristwatch 40, the electronic wristwatch 40 simply returns to the normal basic clock mode; however, the electronic wristwatch 40 may standby for restart of the connection for a predetermined period of time or make the user select whether to return to the basic clock mode.

In the embodiment, the wristwatch 40 returns to the normal basic clock mode when the control mode according to the application operation of the smartphone 10 is ended; however, the wristwatch 40 may return to the function mode which was executed before the shift to the control mode.

The smartphone 10 does not need to search for all the applications which are activated and operable by the electronic wristwatch 40 every time, and the smartphone 10 may only set whether to receive an operation request from the electronic wristwatch 40 for an application for which the operation screen is displayed.

Though the Bluetooth is cited as an example of short-range wireless communication in the embodiment, others such as ZIGBEE (registered trademark) may be used, for example.

Though the embodiment has been described by citing the electronic wristwatch as an example, the present invention can also be applied to electronic timepieces such as a pocket watch which is compact and can be carried with the smartphone and to various electronic devices which have functions of time counting and displaying of the counted current time and are worn on a part of body such as arms to be used as electronic timepieces.

Though the embodiment has been described by citing the smartphone 10 as an example of the external device which is the target to be operated by the electronic wristwatch 40, the operation target may be other electronic devices capable of short-range wireless communication, the other electronic devices including a mobile phone (feature phone), a PDA (Personal Digital Assistant), an audio playback device, a sound recorder, a picture recorder, an image reproducing device, various electronic measurement devices, a tablet terminal and an application software such as laptop and desktop PCs (Personal Computers), for example.

Though several embodiments of the present invention have been described above, the scope of the present invention is not limited to the above embodiments, and includes the scope of inventions, which is described in the scope of claims, and the scope equivalent thereof.

The entire disclosure of Japanese Patent Application No. 2013-261075 filed on Dec. 18, 2013 including description, claims, drawings, and abstract are incorporated herein by reference in its entirety.

What is claimed is:

1. An electronic timepiece, comprising:

a first operation unit which has a plurality of operation receiving units and which outputs an input signal corresponding to an input operation to the operation receiving units, the plurality of operation receiving units including a push button switch;

a first communication unit which communicates with an external device to receive an external input signal from the external device and to transmit an external output signal to the external device; and a first control unit which performs operation control corresponding to an input signal, wherein:

one of the plurality of operation receiving units is a function switching operation receiving unit for selecting and switching any one of a plurality of function modes which are executable by the first control unit, and (i) when a predetermined push button switch which serves as the function switching operation receiving unit is continuously pressed down for a predetermined period of time in a function mode other than a control mode in which the external device is operated, the first control unit assigns the operation receiving units including the function switching operation receiving unit as external device operation receiving units according to predetermined operation processing to be executed by the external device, (ii) when an input operation to the operation receiving units assigned as the external device operation receiving units is detected, the first control unit transmits an operation request according to the operation processing corresponding to the input operation to the external device via the first communication unit, and (iii) when the same predetermined push button switch which serves as the function switching operation receiving unit is continuously pressed down for a predetermined period of time in the control mode in which the operation receiving units including the function switching operation receiving unit are assigned as the external device operation receiving units, the first control unit ends assignment of the operation receiving units as the external device operation receiving units, and the first control unit shifts to a function mode according to normal time display among the plurality of function modes.

2. The electronic timepiece according to claim 1, wherein, when communication connection with the external device by the first communication unit is disconnected while the operation receiving units are assigned as the external device operation receiving units, the first control unit ends the assignment.

3. An operation setting switching system, comprising:

an external device which includes:

a second communication unit for performing communication; and a second control unit which performs operation control of one or a plurality of applications; and the electronic timepiece according to claim 2, wherein the second control unit includes:

an external operation setting unit which sets whether to receive a predetermined operation request from the electronic timepiece for an application under execution among the applications; and an external operation receiving control unit which performs operation control of the application corresponding to a received operation request when the operation request is received from the electronic timepiece by the second communication unit in a case where the predetermined operation request is set to be received from the electronic timepiece.

4. An operation setting switching system, comprising:

an external device which includes:

a second communication unit for performing communication; and a second control unit which performs operation control of one or a plurality of applications; and the electronic timepiece according to claim 1, wherein the second control unit includes:

an external operation setting unit which sets whether to receive a predetermined operation request from the electronic timepiece for an application under execution among the applications; and an external operation receiving control unit which performs operation control of the application corresponding to a received operation request when the operation request is received from the electronic timepiece by the second communication unit in a case where the predetermined operation request is set to be received from the electronic timepiece.

5. The operation setting switching system according to claim 4, wherein:

the external device includes a second operation unit which receives a user's operation, and the external operation setting unit sets whether to receive the operation request from the electronic timepiece for the application under execution among the applications based on an input operation to the second operation unit by a user.

6. The operation setting switching system according to claim 5, wherein:

the external device includes a display unit, and the external operation setting unit retrieves the application under execution among the applications based on the input operation to the second operation unit by the user and displays a list of the retrieved application on the display unit so as to enable a selection operation by the user.

* * * * *